United States Patent [19]

Stewart

[11] 4,135,355

[45] Jan. 23, 1979

[54] OPENING ROLLER FOR AN OPEN-END SPINNING MACHINE

[75] Inventor: William R. Stewart, Strathmartine, Scotland

[73] Assignee: Wm. R. Stewart & Sons (Hacklemakers) Ltd., Dundee, Scotland

[21] Appl. No.: 828,821

[22] Filed: Aug. 29, 1977

[30] Foreign Application Priority Data

Oct. 4, 1976 [GB] United Kingdom ..... 41088/76

[51] Int. Cl.[2] ..... D01G 15/14; D01H 1/12

[52] U.S. Cl. ..... 57/58.91; 19/112

[58] Field of Search ..... 57/58.91, 58.95; 19/112, 114, 97, 96

[56] References Cited

U.S. PATENT DOCUMENTS

| | | | |
|---|---|---|---|
| 1,154,856 | 9/1915 | Graf | 19/114 |
| 2,488,442 | 11/1949 | Snape | 19/114 |
| 2,939,183 | 6/1960 | Tempest et al. | 19/112 X |
| 3,737,951 | 6/1973 | MacKie et al. | 19/112 X |
| 3,968,542 | 7/1976 | Hollingsworth | 19/112 X |

FOREIGN PATENT DOCUMENTS

| | | | |
|---|---|---|---|
| 696549 | 12/1930 | France | 19/112 |
| 368080 | 2/1939 | Italy | 19/112 |
| 271901 | 2/1928 | United Kingdom | 19/112 |
| 954591 | 4/1964 | United Kingdom | 19/112 |
| 1155605 | 6/1969 | United Kingdom | 19/114 |

*Primary Examiner*—Donald Watkins

*Attorney, Agent, or Firm*—Diller, Ramik & Wight

[57] ABSTRACT

An opening roller for an open-end spinning machine carries an array of pins on its external surface. The pins are arranged in repeating patterns, each pattern comprising from 7 to 12 axially extending rows of equally-spaced pins, the relative dispositions of the pins in adjacent rows being such that the pins lie on lines parallel to a helix which passes through points in the first lines of two adjacent patterns, which points are axially off-set by three times the axial spacing of the pins in 7- or 8-row patterns, four times the axial spacing of the pins in 9- or 10-row patterns or five times the axial spacing of the pins in 11- or 12-row patterns. This arrangement reduces the risk of entanglement of fibres combed by one pin with fibres combed by an adjacent pin in the next row and reduces the tendency of the pins to direct fibres axially along the roller. An open-end spinning machine incorporating the roller is also disclosed.

6 Claims, 4 Drawing Figures

OPENING ROLLER FOR AN OPEN-END SPINNING MACHINE

BACKGROUND TO THE INVENTION

This invention relates to opening rollers for open-end spinning machines.

In open-end spinning machines, a sliver of fibres is separated into individual fibres. The separate fibres are then fed in parallel alignment into a rotating spinning chamber which twists together the fibres to form a yarn which is drawn from the spinning chamber.

The separation of the sliver into individual fibres is carried out on a so-called beater or opening roller which conventionally comprises a cylindrical or conical surface carrying an array of sharp projections. The sliver is fed at a controlled rate on to the rotating opening roller so that the projections dislodge the individual fibres from the sliver, arrange them in parallel alignment, and transfer the fibres into the spinning chamber.

The projections on the surfaces of opening rollers have taken the form of either saw-tooth edges wires wound helically onto the drum, or of arrays of pins projecting from the surface of the drum. Where the drum includes a pinned surface, the pins are usually arranged in axial rows forming a series of repeating patterns.

In order to ensure that the pins of each pattern engage a different point on the sliver as the pins are moved relative to the sliver, each pattern of pins is composed of a series of parallel helical lines one of which extends from the first pin in the first row of the pattern to the second pin in the first row of the adjacent pattern. Consequently, all the pins in each pattern are arranged on different circumferential circles on the surface of the drum.

With these pinning arrangements however, there is a tendency for the fibres to be driven axially of the roller by the helical lines of pins causing bunching and, consequently, poor separation of the fibres, towards one end of the roller.

SUMMARY OF THE INVENTION

It is therefore an object of the invention to provide a pinning arrangement for opening rollers of open-end spinning machines in which an improved separation of fibres is achieved.

It is a further object of the invention to provide a pinning arrangement for an opening roller of an open-end spinning machine in which the fibres are not driven axially across the surface of the roller during opening.

According to the present invention I provide an opening roller for use in an open-end spinning machine having an external surface carrying an array of pins arranged in repeated patterns, each pattern comprising from 7 to 12 axially extending rows of equally-spaced pins, the relative dispositions of the pins in adjacent rows being such that the pins lie on lines parallel to a helix which passes through points in the first lines of two adjacent patterns, which points are axially off-set by three times the axial spacing of the pins in 7- or 8-row patterns, four times the axial spacing of the pins in 9- or 10- row paterns or five times the axial spacing of the pins in 11- or 12-row patterns.

Preferably, each repeating pattern contains 8, 9 or 12 rows of pins.

Whilst I do not wish to be limited by any theoretical considerations, I believe that the improvement in separations which is achieved using the pinning array of the present invention is attributable to the fact that each pin in each array is more widely spaced from its immediate neighbours in the adjacent rows than in the conventional pinning pattern described previously. As a result when a pin engages a fibre of the sliver, the fibre is free to move under the influence of the pin without interference with the neighbouring pins. Consequently, each pin in the array exerts a more independent action on the sliver. Moreover the even spacing of the pins reduces any tendency of the helical arrangement of the pins to drive fibres axially towards one edge of the roller.

The opening roller of the invention will generally comprise a one-piece cylindrical or conical surface into which the pins are set. Any conventional construction for the roller may be adopted. For example, the roller may comprise a hollow drum, the pins projecting through the walls of the drum. To assist in the dynamic balance of the drum, the hollow portion of the drum may be filled with a dense material such as a synthetic resin. This material may itself be coloured to indicate the type of fibre or machine for which the roller is intended.

The pins may be secured in the drum by frictional engagement with apertures in the walls of the drum. Alternatively, pins may be secured in oversize apertures in the external surface of the roller by means of a filler such as a synthetic resin, as, for example described in U.S. Pat. No. 3,730,802. If desired, the pins may project at an acute angle from the surface of the drum.

The spacing of the rows of pins and the spacing between pins in the rows will depend upon the type of fibre being spun and the size of the pins and the roller. Preferably, the spacing between pins in each row is equal to the spacing between the rows.

The invention also includes an open-end spinning machine including an opening roller pinned in accordance with the present invention.

DESCRIPTION OF THE DRAWINGS

An embodiment of the invention will now be described by way of example only with reference to the accompanying drawings in which.

DESCRIPTION OF A PREFERRED EMBODIMENT

Figure 1:
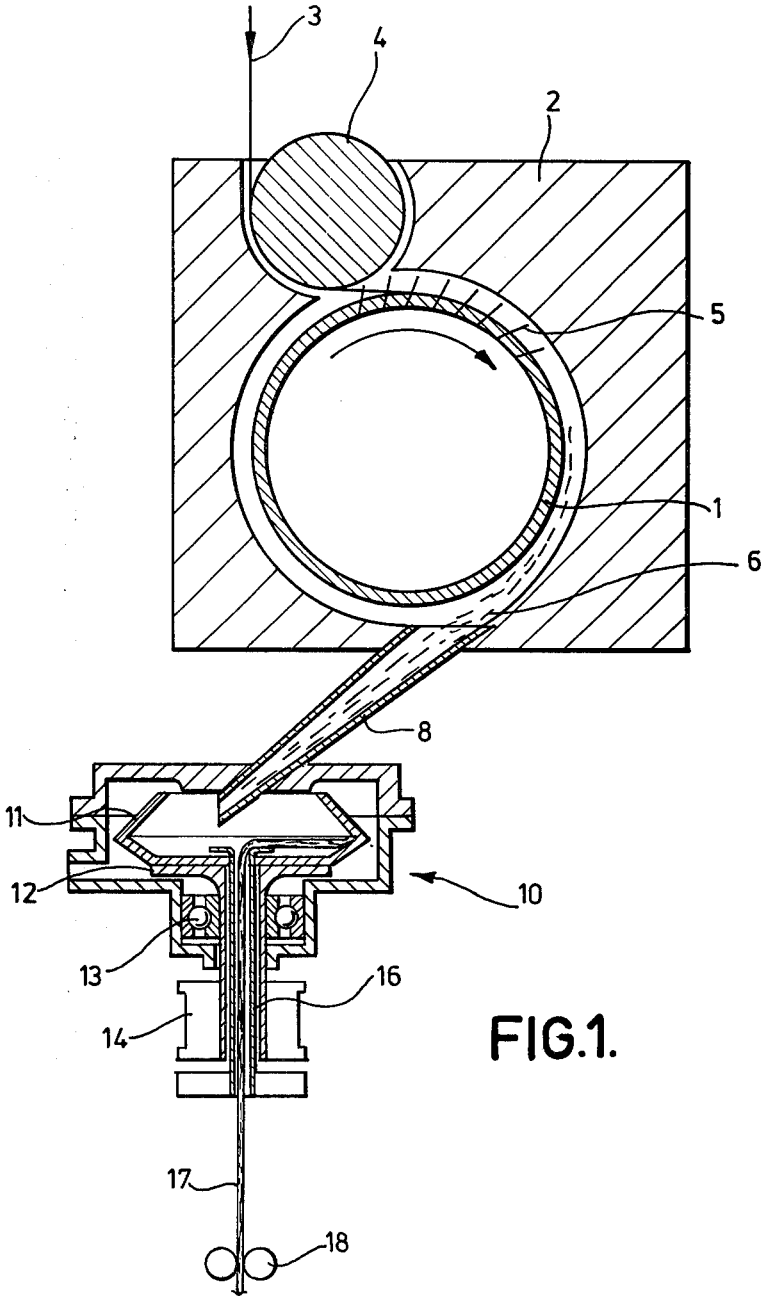
FIG. 1 illustrates, schematically, an open-end spinning machine incorporating an opening roller pinned in accordance with the invention.

Referring to FIG. 1, the open-end spinning apparatus comprises an opening roller 1 rotatably mounted in a housing 2 into which a sliver 3 of fibres is fed over a feed roller 4. As the roller 1 rotates, an array of pins 5 projecting from its external surface separates the sliver 3 into individual fibres 6 which are ejected from the roller 1 through a tapered feed duct 8 into an open-end spinning unit, indicated generally at 10, rotatably mounted on the housing 2 beneath the roller 1.

The spinning unit 10 comprises a bowl-shaped spinning chamber 11 carried on a hollow flanged shank 12. The shank 12 is mounted in ball bearings 13 for rotation about its axis by means of a drive pulley 14. A fixed hollow winding tube 16 extending through the shank 12 into the spinning chamber 11 and conducts yarn 17 from the chamber 11. The yarn 17 is drawn from the chamber 11 by means of a pair of draw-off rollers 18 and is stored on a reel (not shown).

Figure 2:
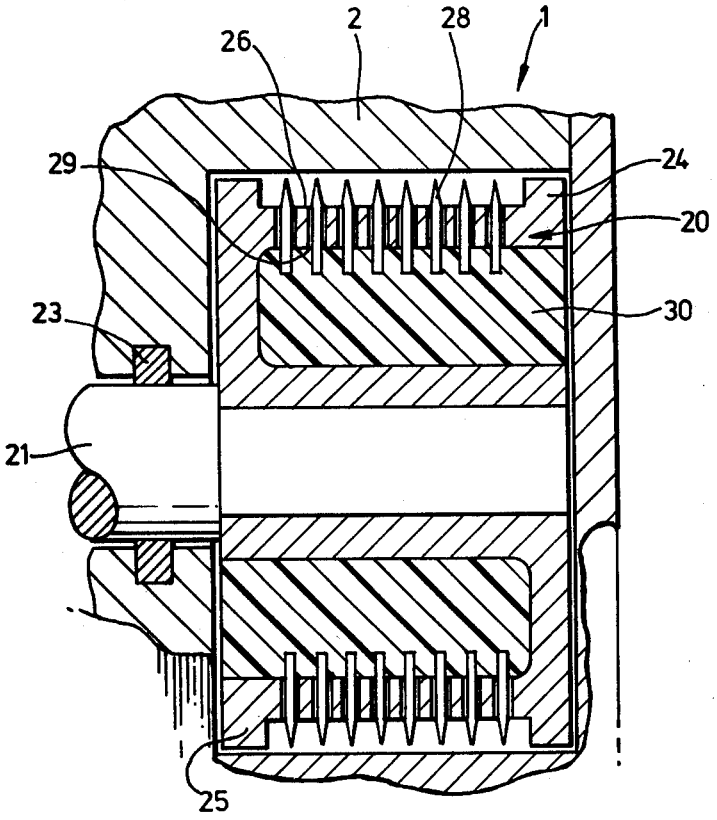
FIG. 2 illustrates the opening roller used in the application of FIG. 1, partly in cross section.

Referring now to FIG. 2, the opening roller 1 comprises a hollow cylindrical one-piece body 20 mounted on a drive shaft 21 supported in the housing 2 in bearings 23. The ends of the body 20 are formed into flanges 24, 25 between which is a recessed cylindrical operating surface 26. The surface 26 is drilled to provide an array of apertures in each of which is mounted a hardened-steel pin 28, each pin being fixed in its respective aperture by means of an epoxy resin adhesive 29 by the method described in U.S. Pat. No. 3,730,802, equivalent to British patent specification No. 1,298,561. The pins 28 project from the operating surface 26 of the roller by an amount less than the radial lengths of the flanges 24, 25 so that the flanges protect the pins from damage during removal of the roller on the drive shaft 21. The hollow interior of the body 20 is filled with a solid plastics material 30 which assists in balancing the roller during operation of the spinning machine. This material may be coloured to assist in identification of the roller.

Figure 3:
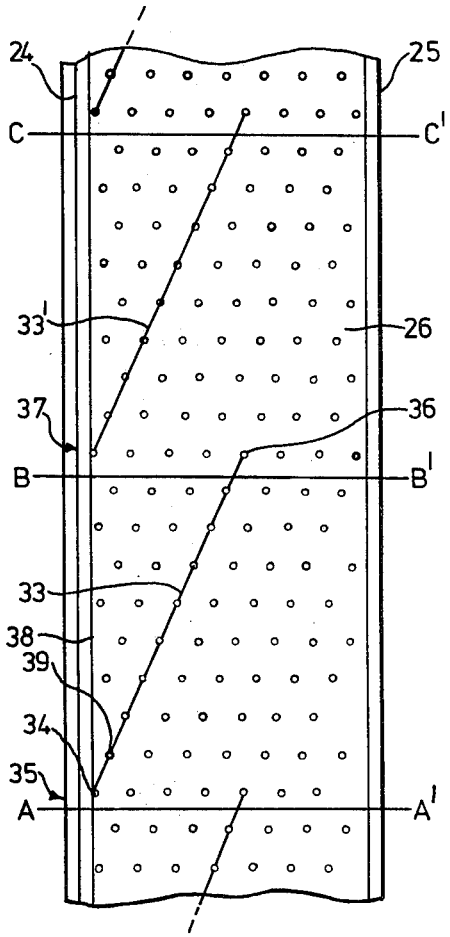
FIG. 3 represents the pinning pattern of a roller of the present invention and FIG. 4 represents a conventional pinning pattern.

The arrangement of the pins 28 in the working surface 26 of the roller 1 is illustrated in FIG. 3. For convenience the cylindrical surface 26 of the roller 1 is illustrated as a rectangle.

The array of pins is arranged in a series of repeating patterns, one of which falls between the lines A, $A^1$ and B, $B^1$, the adjacent pattern falling between the lines B, $B^1$ and C, $C^1$.

Each pattern comprises nine rows of equally-spaced pins the pins in each row being so positioned relative to each other that the pins lie along parallel helical lines around the surface 26 of the roller 1, one of the lines being indicated by the numeral 33. This line extends from a point 34 in the first row 35 of the first pattern of pins to a point 36 in the first row 37 of the adjacent pattern of pins. The points 34 and 36 are occupied by the first and fifth pins in the rows respectively, and are therefore axially off-set from each other by four times the axial spacing of the pins. The pins in the adjacent pattern are arranged similarly to those of the first pattern, the helical line corresponding to the line 33 being indicated at 33'. In all, the working surface 26 of the roller 1 includes eight repeating patterns of pins.

In the pinning arrangement described above, the relative spacings of the pins in each row of any one repeating pattern is such that no two pins fall upon the same circumferencial circle on the working surface 26. Consequently, in use, each of the pins in each pattern acts upon a different part of a sliver fed on to the working surface 26 of the roller 1. In addition, each pin is separated from its neighbours in adjacent rows by a distance only slightly different from the distance between adjacent pins in the same row. The possibility of adjacent pins interferring with fibres engaged by adjacent pins is therefore minimised.

The particular spacing between adjacent pins in each row and between adjacent rows will depend upon the size of the roller 1 and of the pins 29, and also upon the type of fibres to be treated. By way of example however, a typical roller 2½ inches in diameter and made up from pins of 0.039 inches diameter will have its rows spaced from each other by about 0.1 inches, the same spacing being used between the pins in each row. When such a roller is pinned in accordance with the pattern show in FIG. 3, the axial spacing of the first pin in each row from the circumferential circle passing through the pin at point 34 (line 38 in FIG. 3) will be as shown in Table 1:

Table 1

| Row | Axial spacing of first pin (in inches) |
|---|---|
| 1 | 0.000 |
| 2 | 0.048 |
| 3 | 0.095 |
| 4 | 0.036 |
| 5 | 0.084 |
| 6 | 0.024 |
| 7 | 0.071 |
| 8 | 0.012 |
| 9 | 0.059 |

The pattern illustrated in FIG. 3 may be varied in accordance with the invention. Thus, each repeating pattern may be composed of 7, 8, 10, 11 or 12 rows. Where a seven or eight-row pattern is used, the rows of equally-spaced pins are arranged relative to each other so that the helical line corresponding to line 33 in FIG. 3 passes through points in the first rows of two adjacent patterns which are axially offset by three times the axial spacing of the pins (e.g. from the first pin in the first row of the pattern to the fourth pin in the first row of the adjacent pattern). Where a 10-row repeating pattern is used, the corresponding line passes through points in the first rows of adjacent patterns which are axially off-set by four times the axial spacing of the pins, e.g. through the first and fifth pins of the first rows of adjacent patterns, in a manner similar to that shown in FIG. 3. Where an 11- or 12- row repeating pattern is used, the helical line corresponding to the line 33 illustrated in FIG. 3 passes through points in the first rows of adjacent patterns which are axially off-set by five times the axial spacing of the pins, e.g. through the first and sixth pins of the first rows of adjacent patterns.

By way of example, for rollers and pins of a size similar to that described above in connection with Table 1, the spacings for the first pins in each row of an 8- and 12- row pattern are given in Table 2:

Table 2

| Row | Spacing of first pin (in inches) | |
|---|---|---|
| | 8—row pattern | 12—row pattern |
| 1 | 0.000 | 0.000 |
| 2 | 0.040 | 0.045 |
| 3 | 0.080 | 0.089 |
| 4 | 0.013 | 0.027 |
| 5 | 0.054 | 0.071 |
| 6 | 0.094 | 0.009 |
| 7 | 0.027 | 0.053 |
| 8 | 0.067 | 0.098 |
| 9 | — | 0.036 |
| 10 | — | 0.080 |
| 11 | — | 0.018 |
| 12 | — | 0.062 |

In each of these alternative arrangements, the spacing of each pin from its neighbouring is maximised, and each pin in the pattern lies on a different circumferential circle from any of the other pins in the pattern. Repeating patterns having smaller or larger numbers of rows are less suitable for use on opening rollers.

Figure 4:
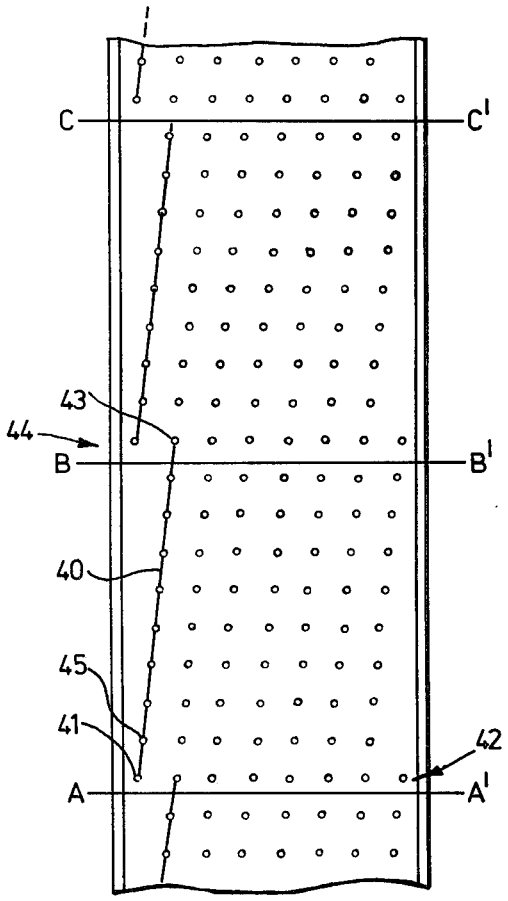

FIG. 4 is a diagram similar to FIG. 3 illustrating a conventional pinning array of an opening roller. This array is composed of a series of repeating patterns each comprising 9 rows of 8 equally-spaced pins arranged along parallel helical lines. In contrast with the patterns of the present invention however, one helical line 40 in the pattern located between lines A, $A^1$ and B, $B^1$ in FIG. 4 extends from the first pin 41 in the first row 42 of the pattern to the second pin 43 in the first row 44 of the adjacent pattern lying between lines B, $B^1$ and C, $C^1$. As a result, although each pin in the pattern is disposed on its own circumferential circle each pin lies comparatively close to one pin in an adjacent row. Thus, the spacing between the first pin 41 in the first row of the pattern between lines A, $A^1$ and B, $B^1$ and the first pin 45 in the second row of the pattern is only marginally greater than the inter-row spacing of the pattern. The corresponding distance between pins 34 and 39 in FIG. 3 is clearly greater. Consequently the likelihood of fibres engaged by any one pin becoming entangled with fibres engaged by adjacent pins is much greater in the roller of FIG. 4 than in the rollers of the present invention. In addition, in view of the more uniform spacing of the pins in the array of the present invention, the tendency of the helical arrangement of pins to direct fibres in the axial direction towards the flange 24 or 25 is much smaller in the array of the present invention than in the array illustrated in FIG. 4.

I claim:

1. An opening roller for use in an open-end spinning machine comprising an external surface carrying an array of pins arranged in repeating patterns, each pattern including from 7 to 12 axially extending rows of equally-spaced pins, the relative dispositions of the pins in adjacent rows being such that the pins lie on lines parallel to a helix which passes through points in the first lines of two adjacent patterns, which points are axially off-set by three times the axial spacing of the pins in 7- or 8- row patterns, four times the axial spacing of the pins in 9- or 10-row patterns or five times the axial spacing of the pins in 11- or 12-row patterns.

2. An opening roller according to claim 1 wherein each repeating pattern contains 8, 9 or 12 rows of pins.

3. An opening roller according to claim 1 wherein the circumferential spacing of the rows of pins is equal to the axial spacing between the pins.

4. An opening roller according to claim 1 including a one-piece cylindrical or conical surface into which the pins are set.

5. An opening roller according to claim 1 wherein the pins are secured in over-size apertures in the external surface of the roller by means of a filler.

6. An open-end spinning machine incorporating an opening roller according to claim 1.

* * * * *